US011353208B2

(12) United States Patent
Veenstra

(10) Patent No.: US 11,353,208 B2
(45) Date of Patent: Jun. 7, 2022

(54) UNDERWATER LED LAMP

(71) Applicant: Innotec, Corp., Zeeland, MI (US)

(72) Inventor: Thomas J. Veenstra, Lakewood, CO (US)

(73) Assignee: Innotec, Corp., Zeeland, MI (US)

( * ) Notice: Subject to any disclaimer, the term of this patent is extended or adjusted under 35 U.S.C. 154(b) by 0 days.

(21) Appl. No.: 17/324,594

(22) Filed: May 19, 2021

(65) Prior Publication Data

US 2022/0065435 A1 Mar. 3, 2022

Related U.S. Application Data

(60) Provisional application No. 62/706,690, filed on Sep. 3, 2020.

(51) Int. Cl.

| | |
|---|---|
| ***F21V 31/00*** | (2006.01) |
| ***F21V 23/00*** | (2015.01) |
| ***F21V 5/04*** | (2006.01) |
| ***E04H 4/14*** | (2006.01) |
| ***F21V 5/00*** | (2018.01) |
| ***F21Y 115/10*** | (2016.01) |
| ***F21W 131/401*** | (2006.01) |

(52) U.S. Cl.

CPC ..... *F21V 31/005* (2013.01); *E04H 4/148* (2013.01); *F21V 5/007* (2013.01); *F21V 5/04* (2013.01); *F21V 23/005* (2013.01); *F21W 2131/401* (2013.01); *F21Y 2115/10* (2016.08)

(58) Field of Classification Search

CPC ..... F21V 31/005; F21V 23/005; F21V 5/007; F21W 2131/401; E04H 4/148

See application file for complete search history.

(56) References Cited

U.S. PATENT DOCUMENTS

| | | | | |
|---|---|---|---|---|
| 7,357,525 | B2 | 4/2008 | Doyle | |
| 7,384,165 | B2 | 6/2008 | Doyle | |
| 7,396,139 | B2 | 7/2008 | Savage | |
| 7,628,512 | B2 | 12/2009 | Netzel, Sr. et al. | |
| 7,744,236 | B2 | 6/2010 | Hsu et al. | |
| 8,100,550 | B2 | 1/2012 | Harris et al. | |
| 8,430,521 | B2 * | 4/2013 | Hui | F21V 19/004 362/101 |
| 8,616,734 | B2 | 12/2013 | Olsson | |
| 9,316,387 | B1 * | 4/2016 | Olsson | F21V 31/005 |
| 9,797,565 | B2 * | 10/2017 | Rapeanu | F21S 9/022 |
| 9,822,962 | B2 | 11/2017 | McGilvray | |

(Continued)

FOREIGN PATENT DOCUMENTS

| | | |
|---|---|---|
| CN | 205140424 U | 4/2016 |
| EP | 1704752 | 9/2006 |

(Continued)

*Primary Examiner* — William N Harris

(74) *Attorney, Agent, or Firm* — Warner Norcross + Judd LLP

(57) ABSTRACT

An underwater lamp with improved light distribution for underwater applications. The underwater lamp includes a circuit trace having non-coplanar circuit segments, LEDs mounted on the non-coplanar circuit segments so as to emit light in nonparallel directions, and a lens. The lens includes lens portions aligned with the LEDs on the circuit trace circuit segments. The lens may be a thermoplastic material encapsulating the LEDs and the circuit trace.

10 Claims, 12 Drawing Sheets

(56) References Cited

U.S. PATENT DOCUMENTS

| | | | | |
|---|---|---|---|---|
| 2007/0139913 | A1* | 6/2007 | Savage | F21V 31/04 362/101 |
| 2009/0279295 | A1 | 11/2009 | Van Der Poel | |
| 2012/0113633 | A1 | 5/2012 | Bowen | |
| 2012/0155088 | A1* | 6/2012 | Spaccasassi | F21V 19/02 362/249.04 |
| 2012/0182731 | A1* | 7/2012 | Kretschmann | F21V 19/0055 362/235 |
| 2013/0170212 | A1* | 7/2013 | Cuda | F21V 29/00 362/249.02 |
| 2013/0182442 | A1* | 7/2013 | Potucek | F21V 29/74 362/294 |
| 2013/0223071 | A1* | 8/2013 | Nishimori | F21S 2/005 362/244 |
| 2015/0043212 | A1* | 2/2015 | Coffey | F21K 9/232 362/294 |
| 2017/0175992 | A1 | 6/2017 | Guillet et al. | |
| 2018/0238533 | A1* | 8/2018 | Dyck | F21V 31/005 |

FOREIGN PATENT DOCUMENTS

| | | | |
|---|---|---|---|
| EP | 2383508 | A1 | 11/2011 |
| WO | 2007100837 | A2 | 9/2007 |
| WO | 2013/079442 | | 6/2013 |

* cited by examiner

UNDERWATER LED LAMP

BACKGROUND

The present invention relates to underwater lighting, and more particularly to underwater LED lighting.

The light distribution provided by light-emitting diode (LED) lamps is difficult to control in underwater lighting applications. The reason for this is that light distribution is accomplished by introducing one or more lenses. Lenses function based on the principle of Snell's law, which describes how light bends when it transitions between mediums having different indexes of refraction. The index of refraction for lens materials is comparable to the index of refraction for water. Thus, the effectiveness of a lens becomes significantly diminished when the lens is submerged in water. A lens can effectively control the direction of light when the lens is in air, but the same lens has significantly less ability to control the light when the lens is in water.

It is also noted that LED light sources naturally produce a Lambertian pattern of light, which means they are somewhat directional light sources. Lamps that are designed to produce a broader pattern of light using LED light sources need to achieve higher levels of light bending, for example, by including one or more lenses to control the light emitted from the LED.

An application where these practicalities can be problematic is in underwater pool lighting. One such problem occurs where the light from a pool lamp that is emitted higher than approximately 40 degrees above horizontal. In this condition, the light exceeds the Total Internal Refraction (TIR) angle at the surface of the water. This light therefore exits the water and creates a high-glare condition on the side of the pool opposite the lamp. (See FIG. 14.) An additional problem occurs where areas within the pool that are at, or near, 90 degrees from direction of the lamp (e.g. the corners of a rectangular pool) can be difficult to illuminate, thereby leaving dark shadows in the pool.

SUMMARY

The present invention is an underwater lamp including two or more LEDs positioned on non-coplanar surfaces which allows for light to be aimed from offset planes or in nonparallel directions. The present invention controls the directionality and overall pattern of the light by aiming the LEDs according to an intended pattern. This approach takes advantage of the reality that LEDs are somewhat directional light sources to begin with.

The lamp includes two or more LEDs mounted on two or more non-coplanar, geometric planes. Optionally, the lamp may include a transparent protective cover layer over the LEDs. When the lamp with a cover layer is submerged in water, the outer surface of the cover layer contacts the water; and the cover layer is therefore optically coupled with the water. The cover layer may be a clear encapsulating material that does not result in an air gap between the LEDs and the material. Sample materials include, but are not limited to, clear coating, clear potting compound, clear urethane pour-over and clear urethane overmolding. Alternatively, the cover layer may be a lens that results in an air gap between the LEDs and the lens.

In situations where it is desirable to provide a lamp with a wide pattern of light across one or more of its axes, the lamp will require multiple LEDs positioned on different planes.

Lenses can be included in the lamp to provide a secondary role in shaping the emitted beam pattern. However, this alternative will require an air gap between the LEDs and the lens. In addition, the lens must be positioned according to the direction of the LEDs. The plane of the lens should substantially align with the plane of the LEDs.

With the LEDs aimed according to a desired beam pattern, the air gap between the LEDs and the lens can be reduced or eliminated without significant compromise to the intended beam pattern. The advantage of eliminating the air gap is that this approach improves thermal management by reducing or eliminating convection stages within the thermal path.

According to a disclosed embodiment, the underwater lamp includes a circuit trace, a plurality of LEDs on the circuit trace, a substrate supporting the circuit trace and the LEDs, and a cover layer. The circuit trace includes a plurality of non-coplanar portions or circuit segments, and at least some of the LEDs are mounted on the circuit segments to emit light in nonparallel directions or from staggered emission points. The cover layer can include discrete angled portions corresponding to the angled circuit segments.

These and other advantages and features of the invention will be more fully understood and appreciated by reference to the description of the current embodiments and the drawings.

DESCRIPTION OF THE CURRENT EMBODIMENTS

Figure 1:
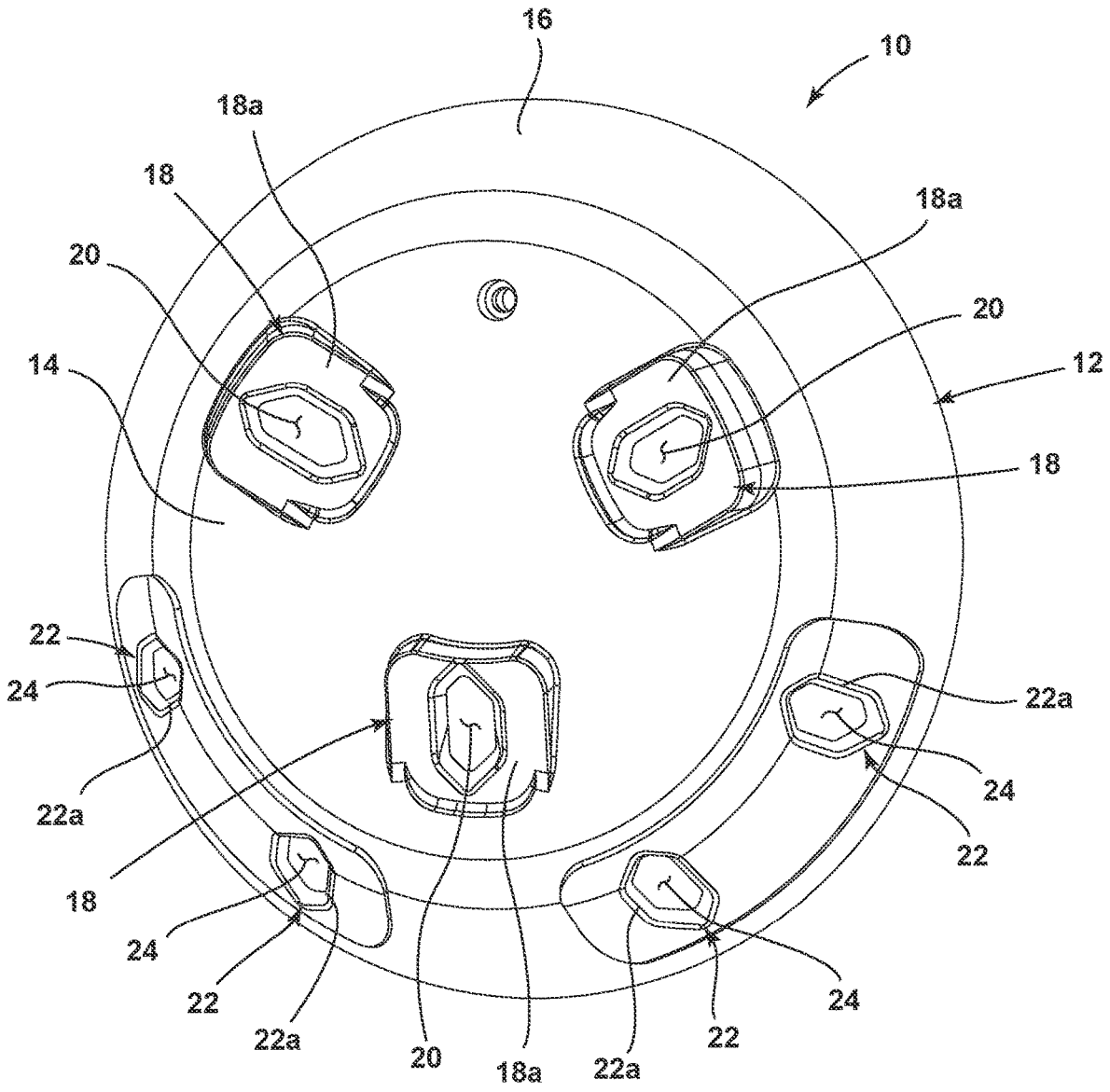
FIG. 1 is a front perspective view of an underwater lamp, according to one embodiment.
Figure 2:
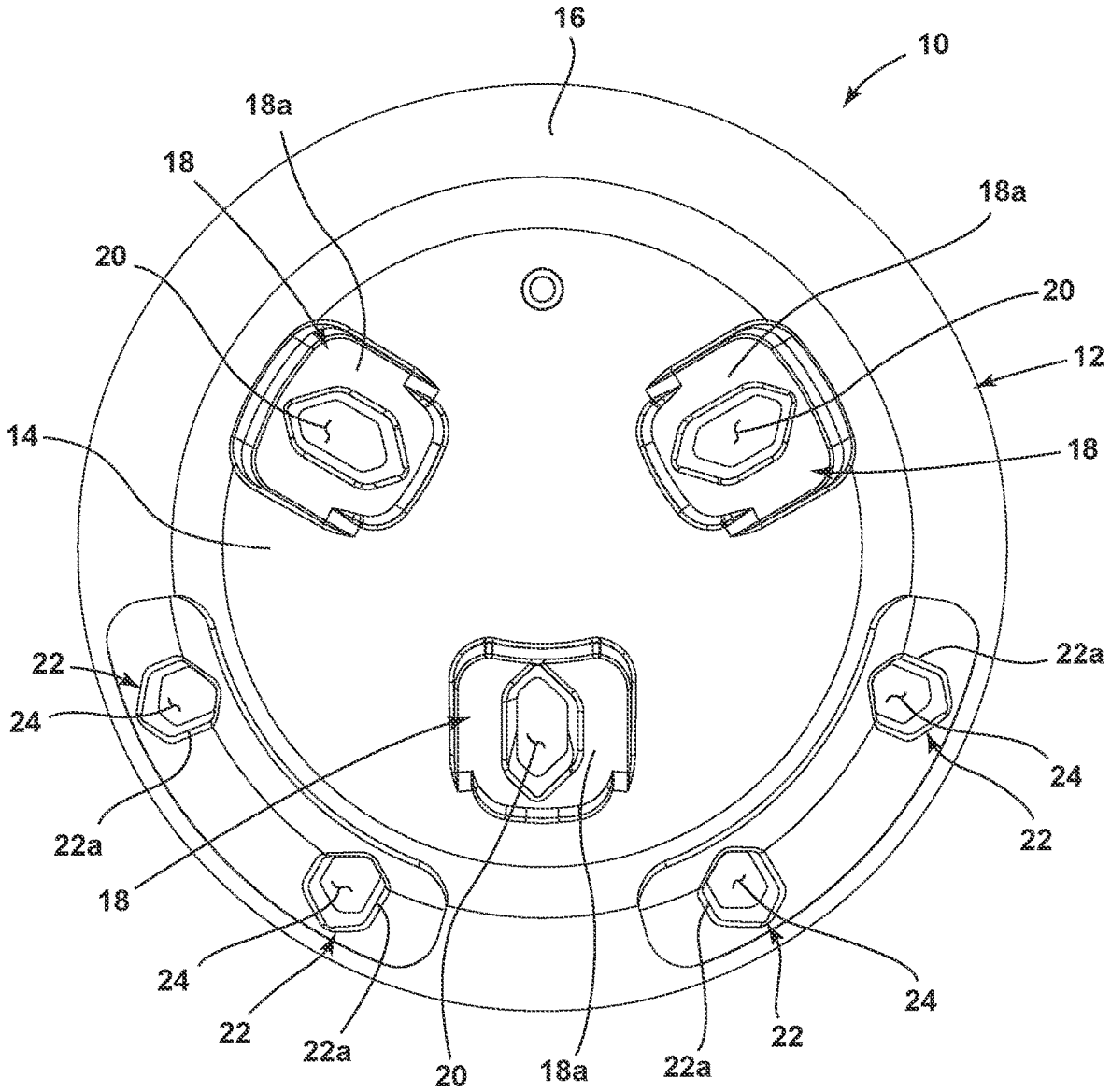
FIG. 2 is a front view of the underwater lamp.

Before the embodiments of the disclosure are explained in detail, it is to be understood that the disclosure is not limited to the details of operation or to the details of construction and the arrangement of the components set forth in the following description or illustrated in the drawings. The disclosure may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting to any specific order or number of components. The use of enumeration also should not be construed as excluding from the scope of the disclosure any additional steps or components that might be combined with or into the enumerated steps or components.

For purposes of description herein, the terms "upper," "lower," "right," "left," "rear," "front," "vertical," "horizontal," and derivatives thereof shall relate to the embodiment as oriented in FIG. 1. However, it is to be understood that the embodiment may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

A light-emitting diode (LED) lamp with improved light distribution for underwater applications is provided. As will be appreciated from the description herein, the present underwater lamp (a) improves the ability to manage underwater light distribution, (b) provides an illumination area that is better lit, and (c) reduces or eliminates glare at the water surface. The disclosed design also reduces or eliminates the air gap around the LEDs, which improves the efficiency and management of dissipating heat from the LEDs. The underwater lamp may be used for a variety of underwater lighting applications, including lighting for a pool, boat, dock, fountain, water feature, or aquarium.

One embodiment of an underwater lamp is illustrated and generally designated at 10. The underwater lamp 10 generally includes a housing 12, multiple LEDs 30, a circuit trace 40, and a lens frame 60. "Circuit trace" as used in this application includes equivalent, similar, and other suitable technologies, such as a PCB (printed circuit board), multiple PCBs, multiple MCPCBs (metal core printed circuit boards), a flex circuit, a lead frame, and a wire harness.

Referring to FIGS. 1-5, the housing 12 can provide an enclosure to the components contained therein and generally includes a front surface 14, a sidewall 16, and several discrete, angled light emitting segments 18. In the illustrated embodiment, the housing 12 is shown as being circular; however, it is contemplated that other shapes are feasible as well. The housing 12 may be formed of a polymer material and may be transparent or may be colored to provide a specific appearance.

The light emitting segments 18 can be disposed at an angle A (see FIG. 4) with respect to the front surface 14, extending outward from the front surface 14. Each light emitting segments includes one or more LEDs or other light sources, which may be embedded in the light emitting segment. The light emitting segments 18 can also be positioned on the housing 12 at selected locations on the front surface 14 and the sidewall 16. Together, the angle A and positioning of each light emitting segment 18 on the housing 12 can provide a light emitting segment 18 orientation. The light emitting segments 18 can be oriented on the housing 12 such that a plane defined by an exterior surface 18*a* of each one of the light emitting segments 18 can be non-coplanar relative the exterior surfaces 18*a*/planes of the other light emitting segments 18. The exemplary angle A is shown as approximately 30°; however, the angle A may be provided in a range of 1 degree to 179 degrees. Further, the angle A at which each of the light emitting segments 18 is disposed need not be the same. The illustrated example shows the light emitting segments disposed at similar angles; however, the light emitting segments may be oriented at different angles A as desired for the selected application. Additionally, the position of the light emitting segments 18 on the front surface 14 of the housing 12 may be different than the illustrated example. While the illustrated example includes three light emitting segments, it is contemplated that fewer or more light emitting segments could be included to suit different lighting needs. Each light emitting segment 18 includes an opening 20 through the exterior surface 18*a*, the purpose of which will be described in greater detail below.

The housing 12 sidewall 16 can include side light emitting segments 22, each including an opening 24 therethrough. The side light emitting segments 22 can be disposed at an angle B (see FIG. 4), relative to the front surface 14. The side light emitting segments 22 can be positioned on the sidewall 16 at selected locations. Together, the angle B and location of each side light emitting segment 22 on the sidewall 16 provide a side light emitting segment 22 orientation. The side light emitting segments 22 are oriented on the sidewall 16 such that a plane defined by an exterior surface 22*a* adjacent each one of the side light emitting segments 22 can be non-coplanar relative the exterior surface 22*a*/plane of the other side light emitting segments 22. The exemplary angle B is shown as approximately 55°; however, the angle B may be provided in a range of 1 degree to 179 degrees. While the illustrated example includes four side light emitting segments 22, it is contemplated that fewer or more side light emitting segments can be included to suit different lighting needs.

Figure 3:
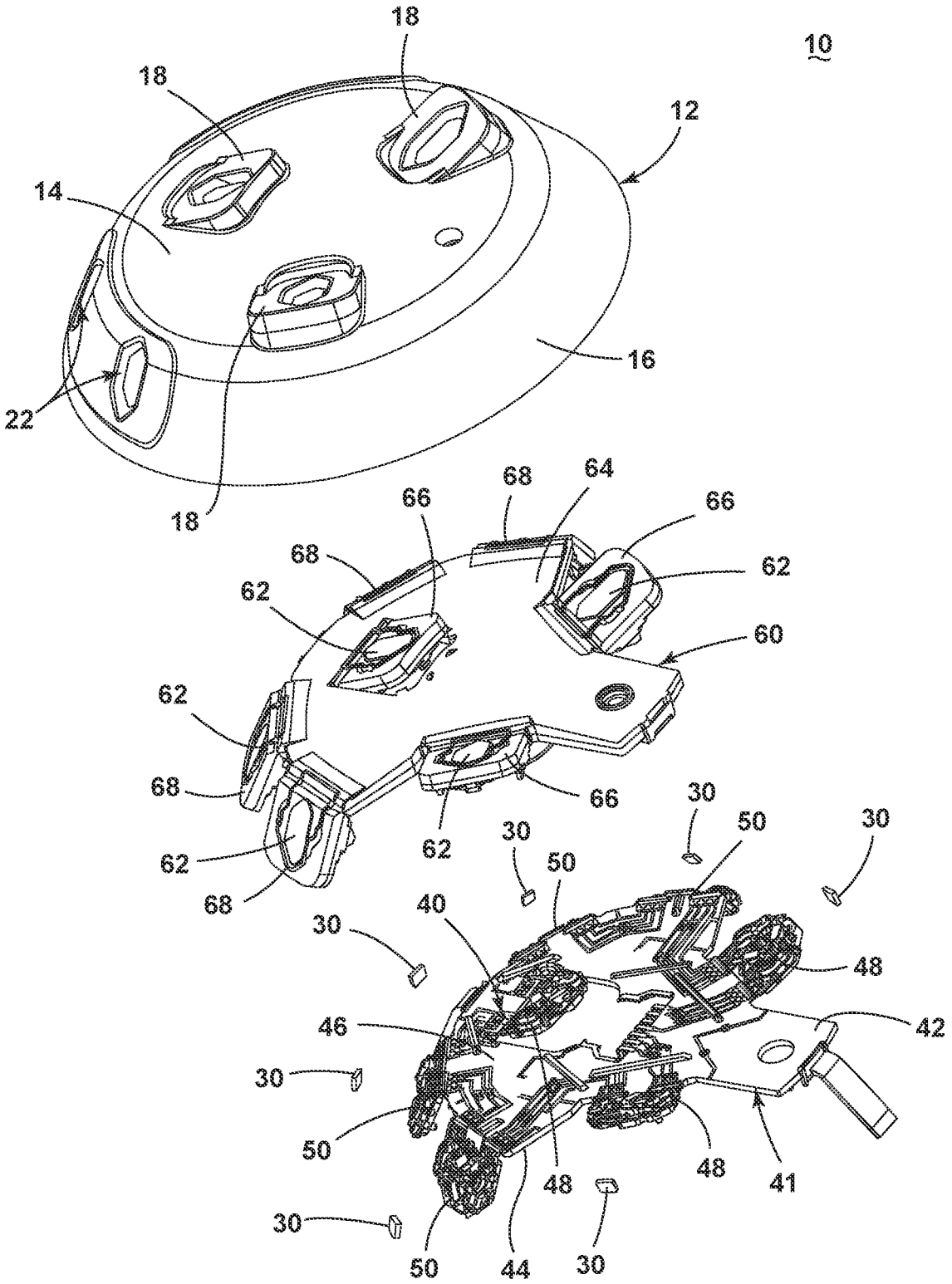
FIG. 3 is an exploded perspective view of the underwater lamp.
Figure 4:
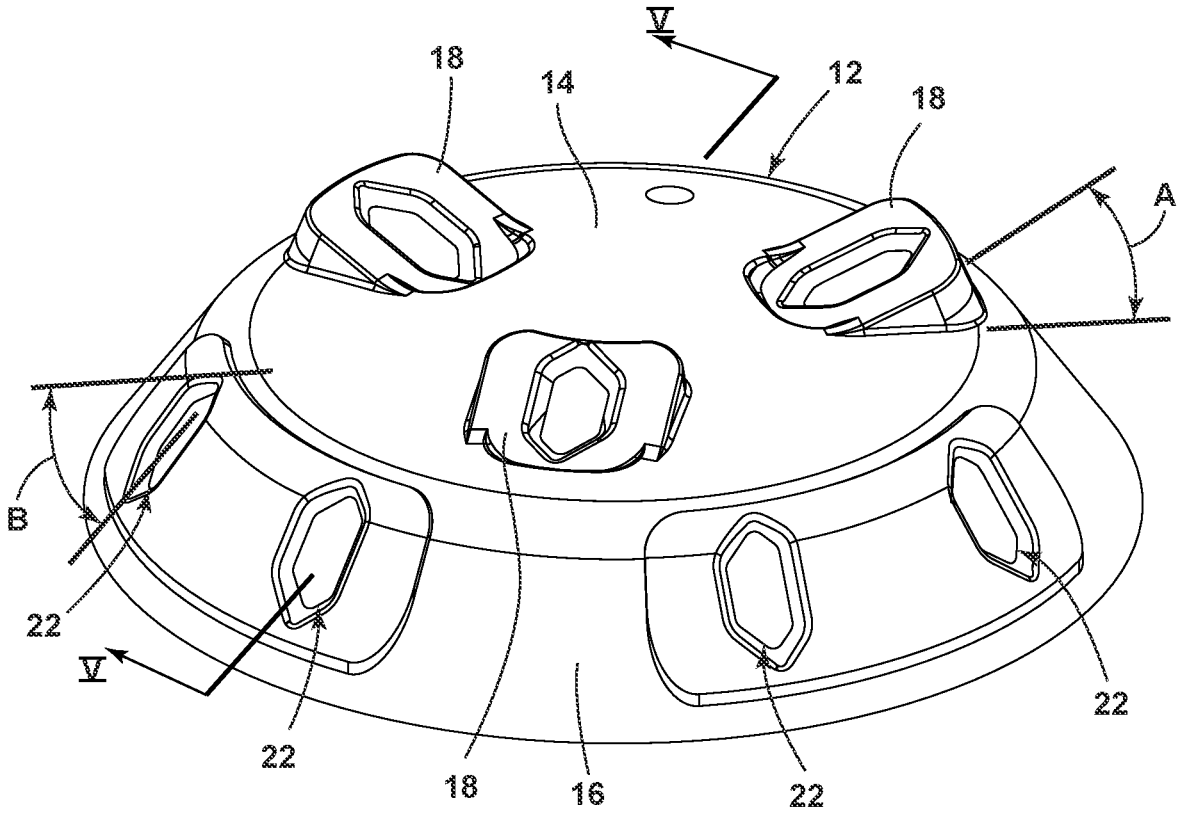
FIG. 4 is a side perspective view of the underwater lamp.
Figure 5:
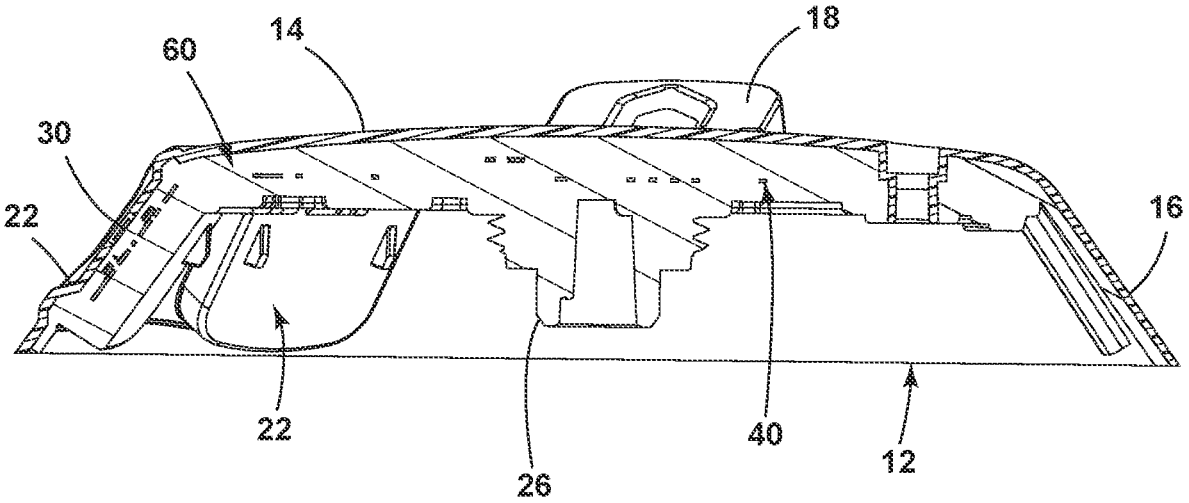
FIG. 5 is a cross-sectional view of the underwater lamp, taken through line V-V of FIG. 4.

The internal electrical components of the underwater lamp 10 may include one or more electrically conductive circuit traces 40 and LEDs 30 supported on or by a substrate 41, shown in FIGS. 3 and 5. The substrate 41 has a front surface 42 and an opposite rear surface 44; the LEDs can be mounted to the front surface 42. The circuit trace 40 may be constructed according to known methods, and any various electrical components such as LEDs 30 may be connected to conductive material utilizing known methods and materials. The circuit trace 40 can include a single conductive circuit element formed by cutting and/or bending sheet metal or the like. LEDs 30 and/or other electrical components can be positioned and secured to the circuit trace 40 utilizing any suitable method.

Optionally or alternatively, the underwater lamp 10 may include one or more conventional printed circuit boards (PCBs), and the electrical components may be secured to the PCBs and/or the circuit element.

LEDs 30 are a directional light source and any color LED 30 and lens material, described below, may be utilized according to the requirements of the particular application. Optionally, the LEDs can be of different colors, such that underwater lamp 10 can produce light of different colors. Additional electrical components which may be included on the circuit trace 40 include resistors, capacitors, diodes, transistors, photosensors, inductors, microprocessors, light sensors, temperature sensors, or other such electrical devices or components.

The circuit trace 40 can have a primary portion 46 and multiple angled portions or circuit segments 48 extending outwardly from the primary portion 46. The circuit segments 48 can be angled substantially the same as their respective housing 12 light emitting segments 18, and the LEDs can be mounted to the front surface 42 of each circuit segment 48. The circuit segments can include side circuit segments 50, which can also be angled and extend rearward from the primary portion 46. The side circuit segments 50 can be angled substantially the same as their respective sidewall 16 side light emitting segments 22, and the LEDs can be mounted to the front surface 42 of each side circuit segment 50.

Figure 7:
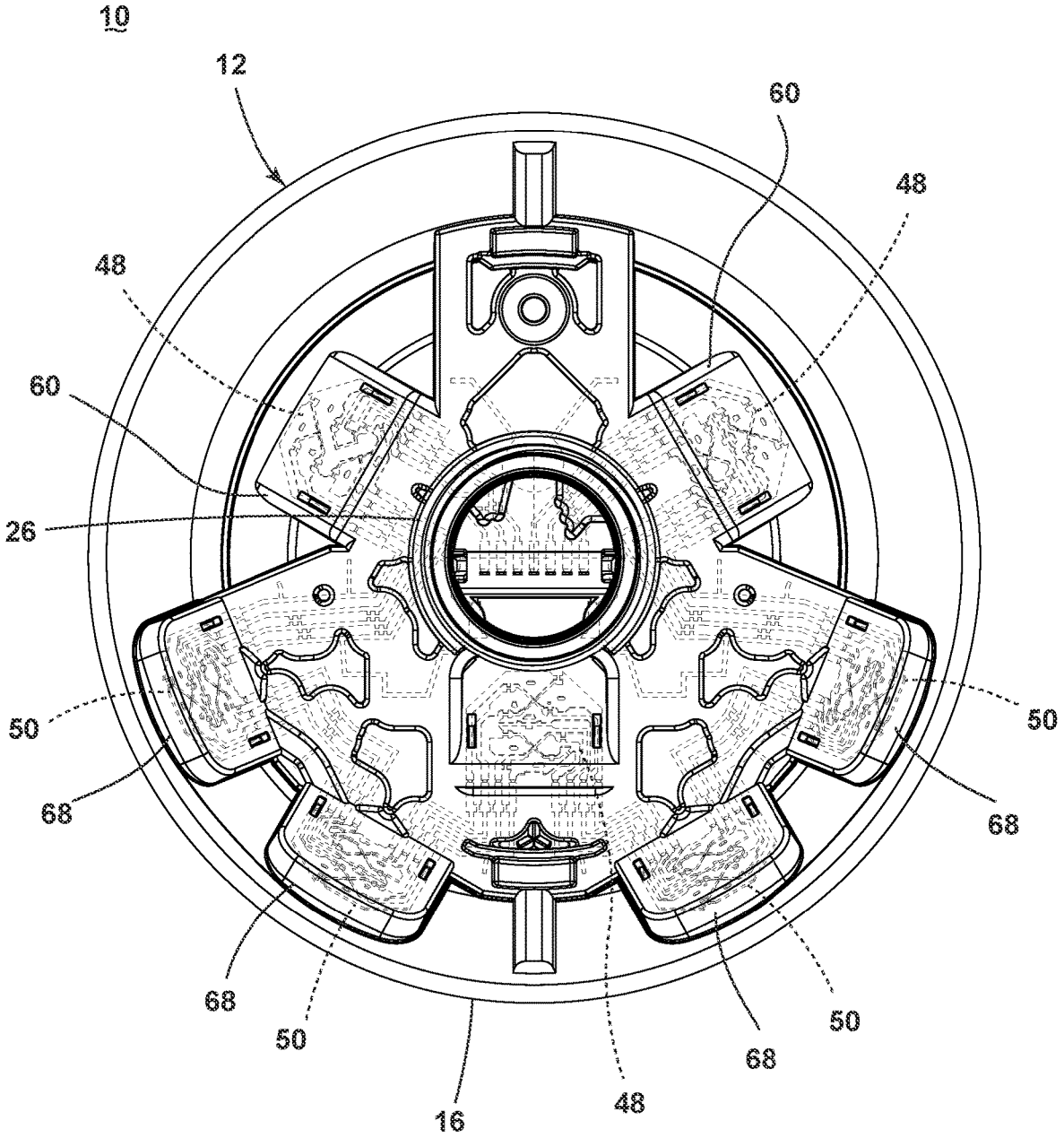
FIG. 7 is a rear view of the underwater lamp.

Referring to FIGS. 3, 5, and 7, the lens frame 60 can be formed of light-transmitting, thermoplastic polymer material and can include a lens 62, a main body portion 64, and several discrete angled portions 66 which can be angled relative to the main body portion 64. The angled portions 66 extend outwardly from the main body portion 64 and can be angled substantially the same as their respective housing 12 light emitting segments 18. The lens angled portions can also include side lens portions 68, which can be angled relative to the main body portion 64 and extend rearward therefrom. The side lens portions 68 can be angled substantially the same as their respective sidewall 16 side light emitting segments 22. The lenses 62 may be integrally formed with the lens frame 60 when the lenses 62 and the lens frame 60 are both light-transmitting materials.

An optically transparent thermoplastic polymer material can be used to encapsulate the LEDs 30 and at least the front surface 42 of the circuit trace 40. The thermoplastic polymer material encapsulates the LEDs 30 such that there is substantially no air gap between the lens frame 60 and the LEDs 30, the purpose of which will be discussed below. Any additional electrical components included, such as an integrated circuit, resistor, diode, capacitor, conductor, or virtually any other electrical component(s), can also be at least partially encapsulated within the plastic material. It should be understood that electrical conductors included on the circuit trace 40 can be utilized to provide electrical connections to the embedded circuit components and may include a relatively small exposed external surface to provide for electrical connections. Optionally, rather than having exposed portions of the electrical conductors, the electrical conductors can be completely encapsulated in the plastic material, and an electrical connector can be electrically connected to electrical conductors and embedded within the plastic material as disclosed in U.S. Pat. No. 7,909,482, issued Mar. 22, 2011, entitled "Electrical Device Having Boardless Electrical Component Mounting Arrangement" and U.S. Pat. No. 8,230,575, issued Jul. 31, 2012, entitled "Overmolded Circuit Board and Method" which are both incorporated by reference. Further, the lens can be formed in a single shot or a multi-shot process substantially similar to the process described in U.S. Pat. No. 7,909,482. Alternatively, the lens can be formed as a separate piece in the overall assembly.

A lamp fitting 26 can extend rearward from the lens frame 60, forming an opening through which an electrical interface such as a connector, a solder joint, or crimped wiring can extend. The lamp fitting 26 can also provide a way to affix the underwater lamp 10 to a wall fitting (not shown) or other structure in the selected application. As an example, the lamp fitting 26 can be threaded for threadably mounting the underwater lamp 10 to the wall fitting. Alternatively, the lamp fitting 26 may be integral to the housing 12 instead of the lens frame 60. Further, the lamp fitting 26 can include other suitable attachment means.

The circuit trace 40 (in particular, the circuit segments 48 and side circuit segments 50) and lens frame 60 (in particular, the angled and side lens portions 66, 68) can be disposed within the angled light emitting segments 18 and side light emitting segments 22 of the housing 12. The lenses 62 of lens portions 66, 68 can be visible through the openings 20, 24 in the housing 12 light emitting segments 18, 22. Respective circuit element circuit segments 48 and lens angled portions 66 can be aligned and parallel relative to one another. Similarly, respective circuit element side circuit segments 50 and lens side lens portions 68 can be aligned and parallel relative to one another. Given this parallel arrangement, the LEDs 30 can be positioned to emit light through the lens frame 60 in a direction substantially perpendicular to the circuity segments 48 and the side circuit segments 50. Accordingly, the angle and positioning of the lens frame portions 66, 68 and circuit element circuit segments 48, 50 defined the angle and the position of the LEDs 30 and therefore control the directionality and the source position of each individual LED. The overall the emitted light and the overall light pattern created by the underwater lamp assembly 10 is thereby defined by the independent angles and positions of the circuit segments 48, 50.

Figure 6:
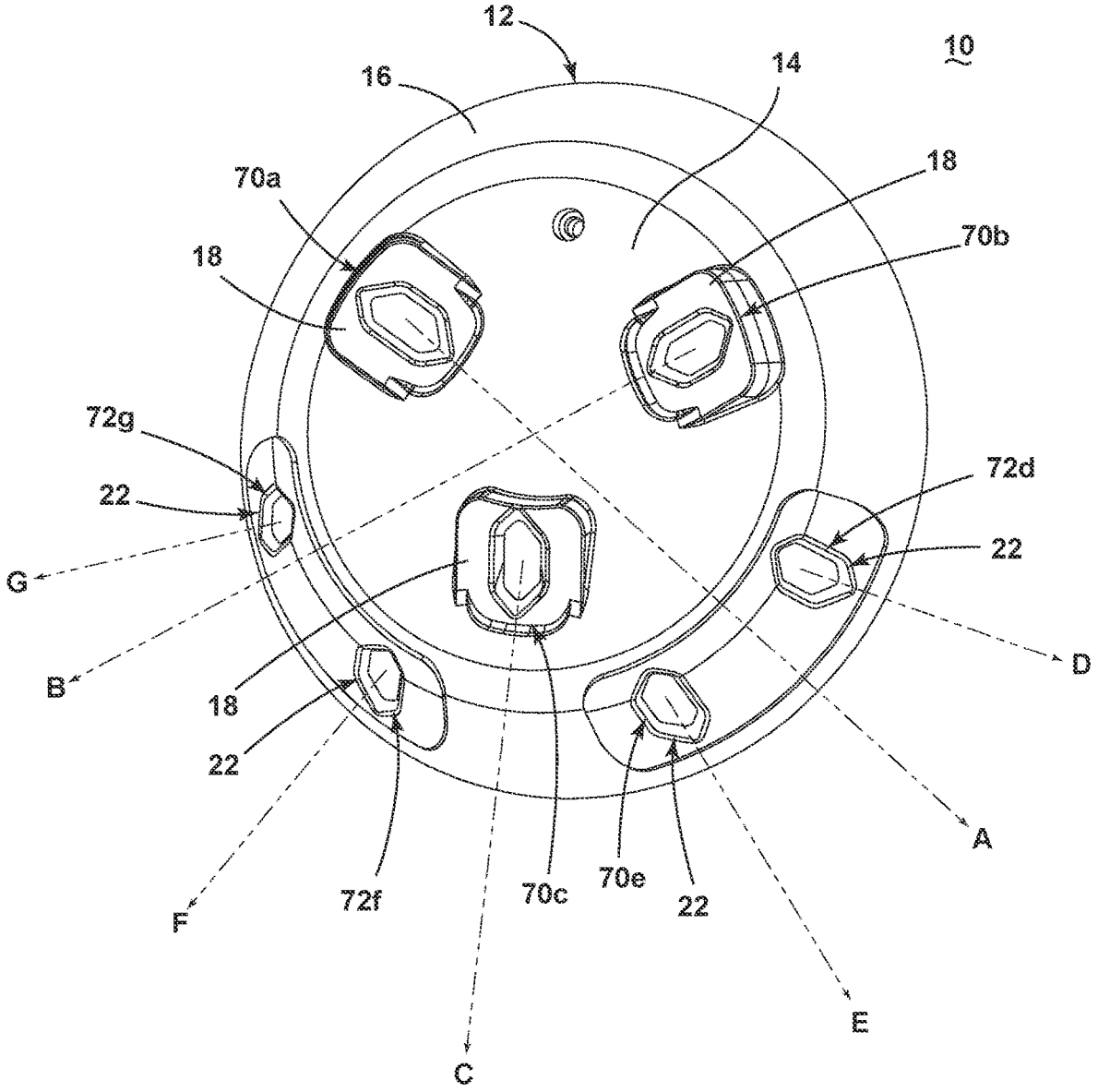
FIG. 6 is a front perspective view of an underwater lamp, illustrating the direction light is emitted by respective LEDs and thus a light pattern provided by the underwater lamp.

Referring to FIG. 6, for descriptive purposes only, the following aligned elements can be considered to define a lamp subassembly 70: circuit element circuit segments 48, lens angled portion 66, and light emitting segment 18; and the following aligned elements can be considered to define a side lamp subassembly 72: circuit element side circuit segments 50, lens side lens portion 68, and side light emitting segment 22.

The illustrated exemplary embodiment of FIG. 6 includes three lamp subassemblies 70 and four side lamp subassemblies 72. The figure shows the direction in which light from each of the LEDs 30 can be aimed. For example, a first of the three lamp subassemblies 70*a* can be oriented to aim light from the respective LED 30 in a first direction A, a second lamp subassembly 70*b* can be oriented to aim light from the respective LED 30 in a second direction B, and a third lamp subassembly 70*c* can be oriented to aim light from the respective LED 30 in a third direction C. Similarly, the four side lamp subassemblies 72*d*-72*g* can be oriented to aim light from their respective LEDs 30 in respective directions D-G. In the illustrated example, the first and second directions A and B can be substantially mirror image, providing substantially the same illumination to both sides of the underwater lamp 10. Additionally, the third direction C can be substantially downward. It should be understood that the first and second directions A and B need not be symmetrical but can be aligned as desired to control the directionality and overall light pattern for the selected application. It is also contemplated that at least the first and second lamp subassemblies 70*a*, 70*b* can be oriented to aim the light directly outward instead of across the front surface 14 of the housing 12.

The disclosed underwater lamp 10 can include different combinations of lamp subassemblies 70 and side lamp subassemblies 72. For example, in the illustrated exemplary embodiment, the underwater lamp 10 includes three lamp subassemblies 70 disposed on the front surface 14 of the housing 12 and four side lamp subassemblies 72 disposed on the sidewall 16 of the housing 12. In exemplary embodiments where the housing 12 is circular, the lamp subassemblies 70 can be radially spaced from one another and the side lamp subassemblies 72 can be spaced along the sidewall 16 to provide a preselected underwater light pattern as desired for the selected application. Because the circuit trace 40 can be bent into a wide variety of shapes, the present underwater lamp is not limited to a substantially flat configuration as with conventional circuit boards. The present circuit element and LEDs may be configured to illuminate a three-dimensional space dictated by other design considerations such as aesthetics, shape and dimensions of the pool or other application, and the like.

When the underwater lamp 10 is submerged, the polymer material that encapsulates the LEDs 30 can protect the LEDs 30 and circuit trace 40 from exposure to water, therefore protecting against electrical shock and promoting safety. The polymeric material encapsulating the LEDs 30 also permits transmission of light from the LEDs with a minimum transmission loss Eliminating, reducing, or and/or controlling the gap between the lens 62 and the LEDs 30 improves light transmission efficiency.

Additionally, encapsulating the LEDs 30 and lens 62 so that no gap or a reduced and controlled air space is included therebetween improves thermal management of the underwater lamp 10. Direct contact of the lens 62, and thereby the LEDs 30, with the water increases the ability to cool the LEDs 30 and improves both intensity and luminosity of the light. When submerged, the water essentially functions as a large heat sink. The assembly 10, which reduces the air gap between the LED 30 and the lens 62, provides improved thermal management because the thermal path from the LED 32 the water is reduced.

Figure 8:
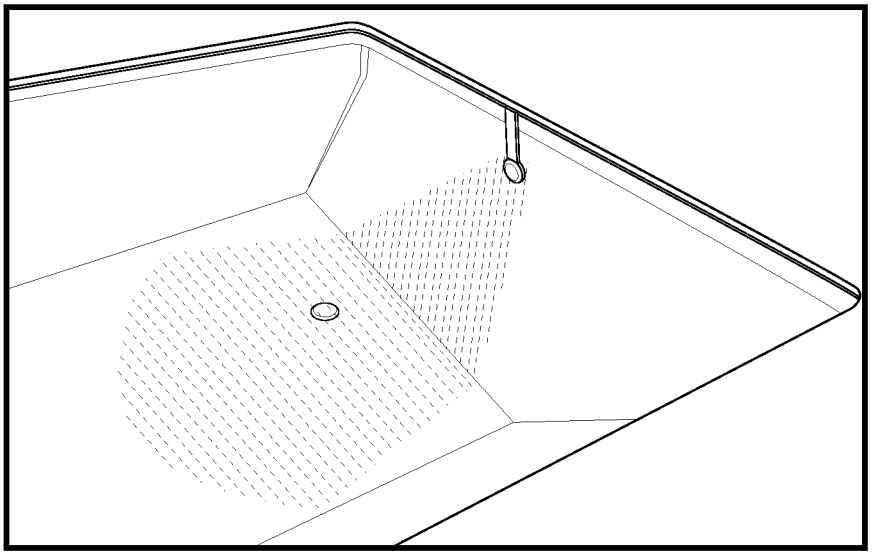
FIG. 8 (PRIOR ART)
FIG. 8 is an example of a prior art underwater lamp mounted in a sidewall of a pool, illustrating a prior art underwater light pattern produced by the prior art underwater lamp.
Figure 9:
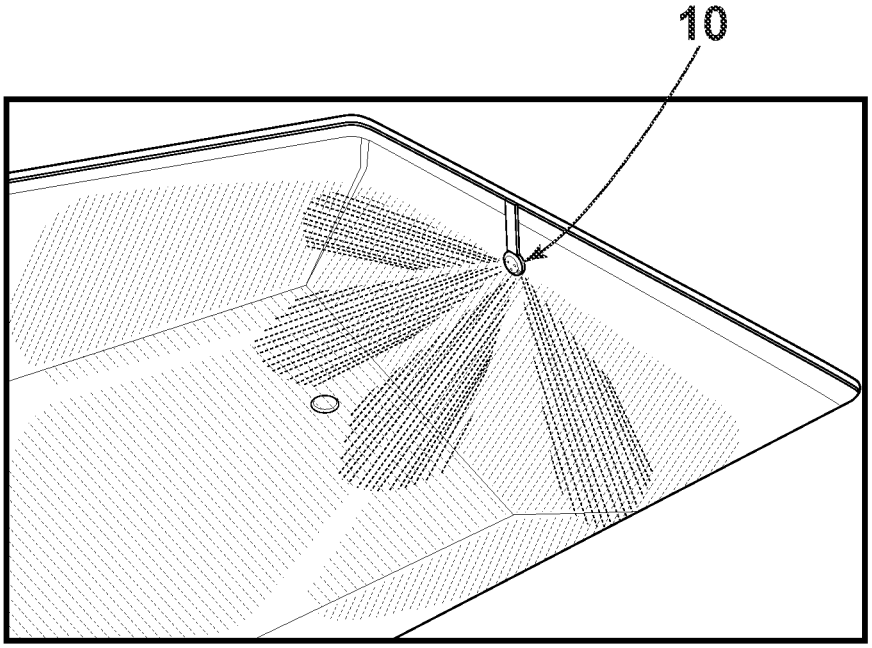
FIG. 9 is an exemplary application of the present underwater lamp mounted in a sidewall of a pool and illustrating an improved underwater light pattern produced by the underwater lamp.
Figure 10:
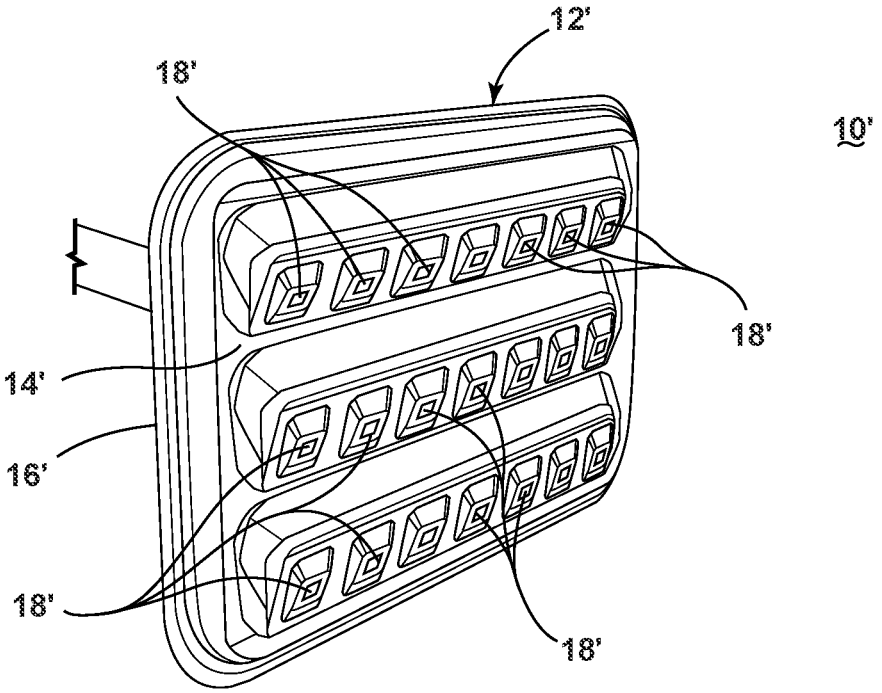
FIG. 10 is a perspective view of an underwater lamp, according to another embodiment.
Figure 11:
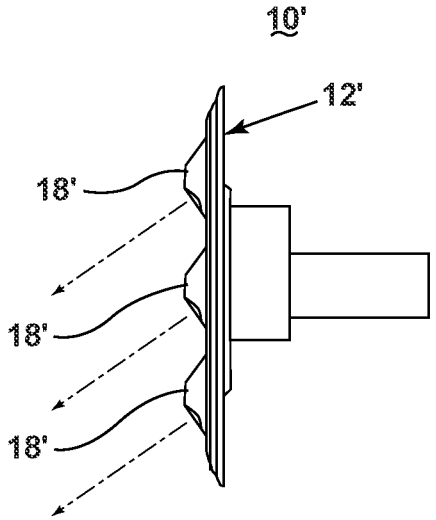
FIG. 11 is a side view of the underwater lamp of FIG. 10.
Figure 12:
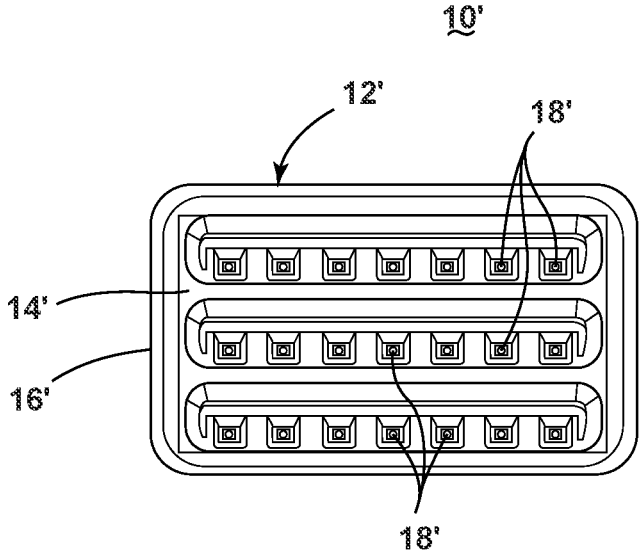
FIG. 12 is front view of the underwater lamp of FIG. 10.
Figure 14:
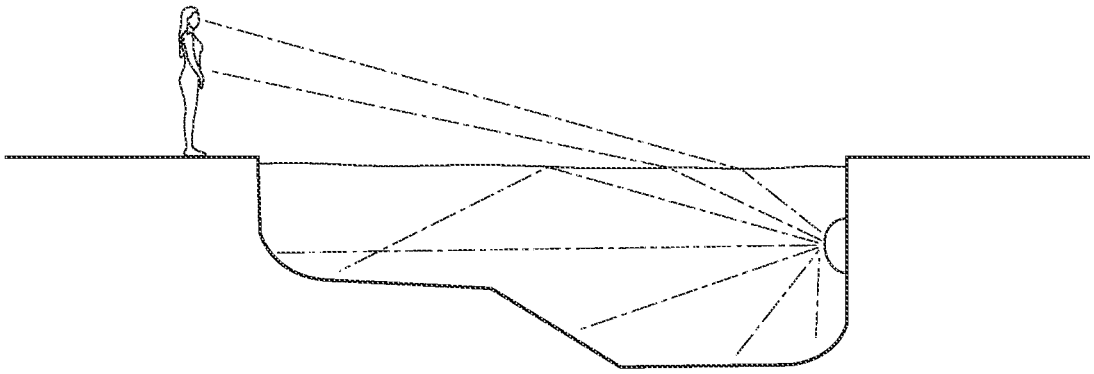
FIG. 14 (PRIOR ART)
FIG. 14 is an example of a prior art underwater lamp mounted in a sidewall of a pool, illustrating a prior art high-glare light pattern produced by the prior art underwater lamp.
Figure 15:
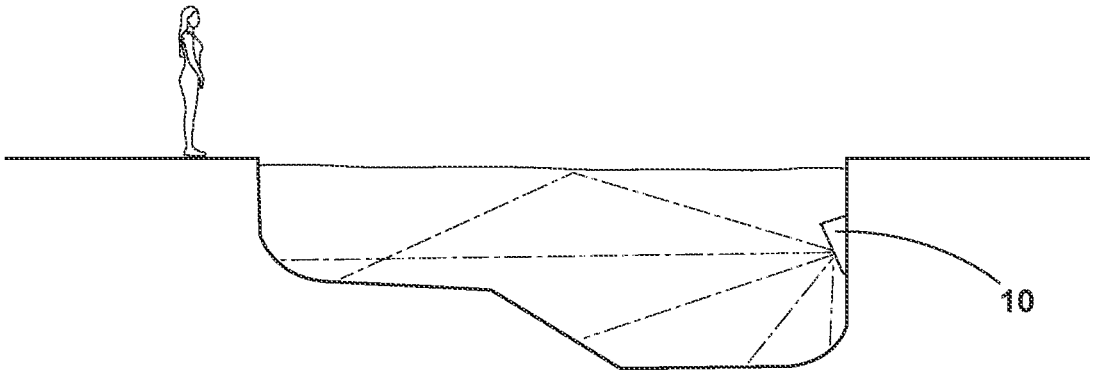
FIG. 15 is an exemplary application of the present underwater lamp mounted in a sidewall of a pool and illustrating an improved low-glare light pattern produced by the underwater lamp.

Referring to FIGS. 8-9 and 14-15, an exemplary application illustrating light distribution within a pool is shown. FIG. 8 shows a conventional underwater lamp mounted to the side of a pool and illustrates a conventional underwater light pattern. FIG. 9 shows an exemplary embodiment of the present underwater lamp 10, mounted to the side of a pool, and illustrating an improved underwater lighting pattern according to embodiments disclosed herein. In comparison, light distribution in a pool can be significantly improved by the disclosed underwater lamp 10. The corners, edges, and interior surfaces of the pool are more visible and are more evenly lit by the underwater lamp 10. Similarly, FIG. 14 shows a conventional underwater lamp mounted to the side of a pool and illustrates a conventional light pattern resulting in high glare above the surface of the water. FIG. 15 shows an exemplary embodiment of the present underwater lamp 10, mounted to the side of a pool, and illustrating an improved lighting pattern according to embodiments disclosed herein. In comparison, the glare of light above the surface of the water pool is significantly reduced by the underwater lamp 10. An underwater lamp is shown in FIGS. 10-12, in accordance with another embodiment of the disclosure. For purposes of brevity, descriptions of similar elements are not repeated here, and like elements are indicated with the same reference numeral bearing a prime (*) symbol. Like the first embodiment, the underwater lamp 10' can include a housing 12 with a front surface 14', a sidewall 16', and multiple angled light emitting segments 18'. Though not visible in the drawings, the underwater lamp 10' also includes multiple LEDs, a lens with angled portions, and a circuit element with angled circuit segments. The LEDs can be encapsulated in the lens material and the circuit element and lens can be oriented such that light from the LEDs is directed perpendicular to the surface of the lens. As described in the first embodiment, the angle and positioning of the angled lens portions and circuit element circuit segments can control the directionality and the overall light pattern provided by the LEDs.

Figure 13:
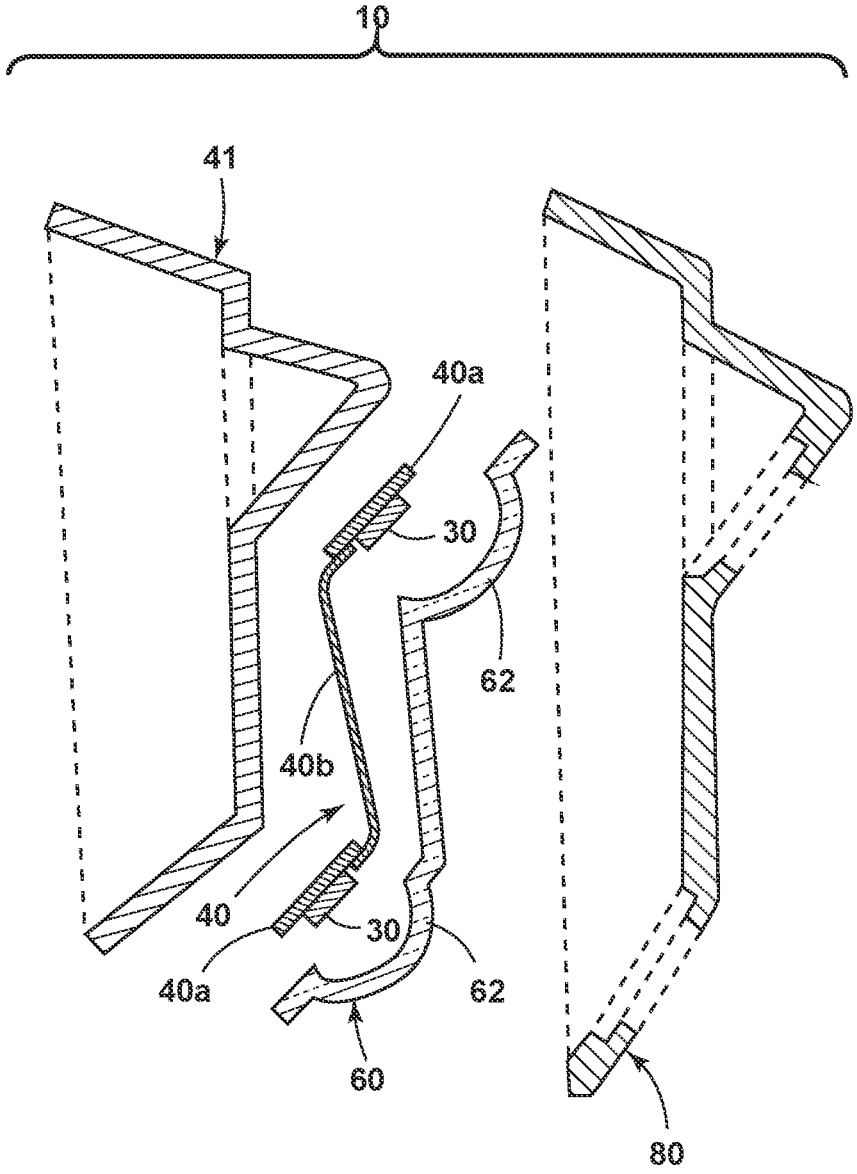
FIG. 13 is an exploded sectional schematic view of the underwater lamp.

FIG. 13 shows a first schematic of selected components of the underwater lamp 10, including the substrate 41, the circuit trace 40 (including the PCBs 40*a* and the flex circuit 40*b*) on the substrate and having at least two parallel portions, the LEDs 30 connected to the circuit traces and in parallel planes, the lens housing 60 including a lens 62 over each LED, and an outer bezel 80. In this embodiment, the substrate 41 serves as a housing supporting the other components. Therefore, "substrate" and "housing" could be used interchangeably in identify this element. The substrate 41 and the bezel 80 extend beyond the circuit traces 40 and are bonded to one another around their full-part perimeters. Alternatively, the substrate 41 and the bezel 80 could be a single integral component. Further alternatively, the substrate 41, the lens housing 60, and the bezel 80 could be a single integral component. Other possible variations of these elements include (a) the flex circuit 40*b* could be replaced by a wiring harness; (b) the lens housing 60 and the bezel 80 could be integrated into a single piece; (c) the PCBs 40*a* could be MCPCBs; (d) the PCBs 40*a* could be eliminated by mounting the LEDs directly on the flex circuit 40*b*; and (e) the lens housing 60 may be multiple pieces such as a separate lens piece for each light bank or bank of light sources (e.g. LEDs).

Figure 16:
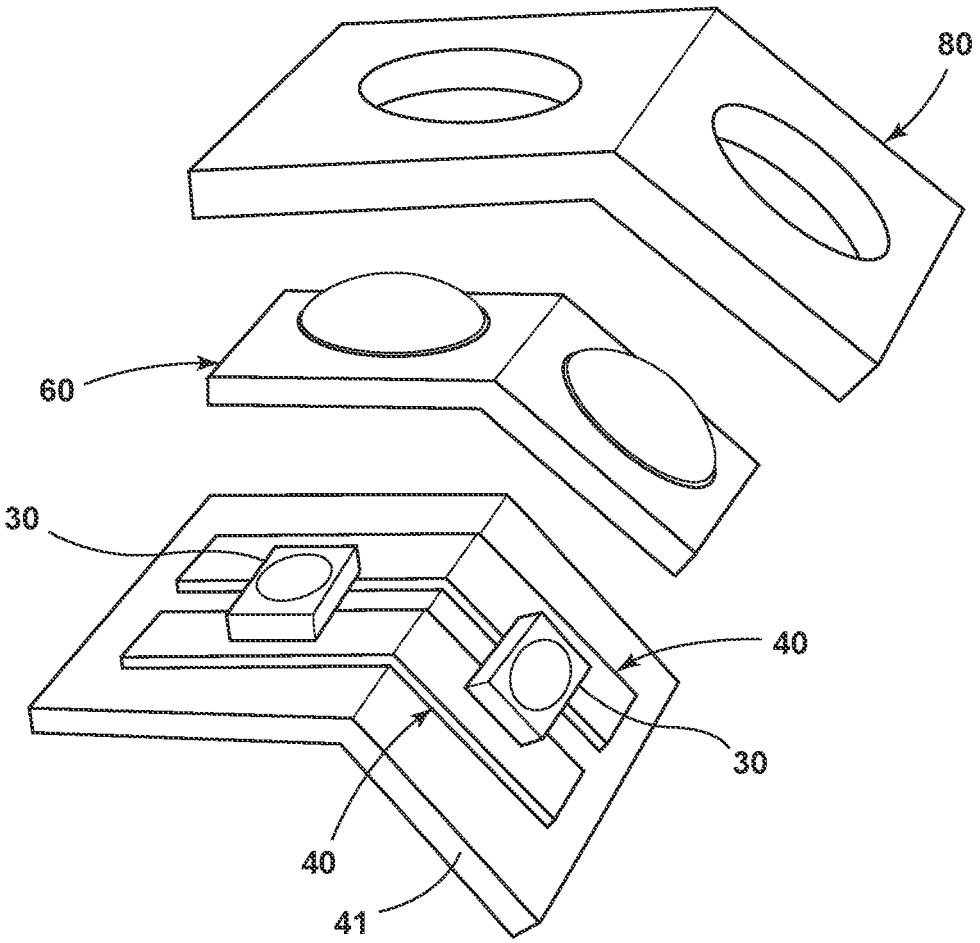
FIG. 16 is an exploded perspective schematic view of the underwater lamp.

FIG. 16 shows a second schematic of selected components of the underwater lamp 10, including the substrate 41, the circuit trace 40 on the substrate and having at least two nonparallel portions, the LEDs 30 connected to the circuit traces and in nonparallel planes, the lens housing 60 including a lens 62 over each LED, and an outer bezel 80. The elements of this second schematic could be modified using one or more of the alternatives identified in the preceding paragraph.

While the disclosure herein relates to the pool and spa industry, the present underwater lamp can be used in other applications where submerged lighting can benefit from being managed efficiently and an improved light pattern is desired. Such other applications could include marine, dock, port, fountain, water feature, and aquarium.

The above description is that of current embodiments of the disclosure herein. Various alterations and changes can be made without departing from the spirit and broader aspects of the disclosure as defined in the appended claims, which are to be interpreted in accordance with the principles of patent law including the doctrine of equivalents. This disclosure is presented for illustrative purposes and should not be interpreted as an exhaustive description of all embodiments of the disclosure or to limit the scope of the claims to the specific elements illustrated or described in connection with these embodiments. For example, and without limitation, any individual element(s) of the described disclosure may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present disclosure is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. An underwater lamp comprising:

a substrate including a plurality of non-coplanar substrate portions, first selected ones of the substrate portions being nonparallel to one another, second selected ones of the substrate portions being parallel to one another;

a plurality of light sources each supported by one of the substrate portions, whereby the light sources are non-coplanar, whereby the light sources supported by the first selected ones of the substrate portions are nonparallel to one another so that the light sources emit light in nonparallel directions, whereby the light sources supported by the second selected ones of the substrate portions are parallel to one another so that the light sources emit light in a parallel direction; and a lens assembly overlying the light sources and the substrate, the lens assembly including a plurality of lens portions each over one of the light sources, there being substantially no air gap between the lens assembly and the light sources.

2. An underwater lamp as defined in claim 1 further comprising a circuit trace including a plurality of circuit trace segments each supported by one of the substrate portions, each light source connected to one of the circuit trace segments.

3. An underwater lamp as defined in claim 1 further comprising a bezel overlying the lens assembly and secured to the substrate.

4. An underwater lamp as defined in claim 3 wherein the lens assembly is a single integral piece.

5. An underwater lamp comprising:

a substrate including a plurality of non-coplanar substrate portions;

a plurality of light sources each supported by one of the substrate portions, whereby first selected ones of the light sources are non-coplanar, first selected ones of the substrate portions being parallel to one another, whereby the light sources supported by the first selected ones of the substrate portions are parallel to one another so that the light sources emit light in a parallel direction, second selected ones of the substrate portions being nonparallel to one another, whereby the light sources supported by the second selected ones of the substrate portions are nonparallel to one another so that the light sources emit light in nonparallel directions; and a lens assembly overlying the light sources and the substrate, the lens assembly including a plurality of lens portions each over one of the light sources.

6. An underwater lamp as defined in claim 1 wherein the light sources comprise LEDs.

7. An underwater pool lamp comprising:

a substrate including a plurality of non-coplanar substrate portions, first selected ones of the substrate portions being parallel to one another;

a plurality of light sources each supported by one of the substrate portions, whereby the light sources supported by the first selected ones of the substrate portions are parallel to one another so that the light sources emit light in a parallel direction, second selected ones of the substrate portions being nonparallel to one another, whereby the light sources supported by the second selected ones of the substrate portions are nonparallel to one another so that the light sources emit light in nonparallel directions, further whereby corners, edges, and interior surfaces of a pool are more evenly illuminated; and a lens assembly overlying the light sources and the substrate, the lens assembly including a plurality of lens portions each over one of the light sources.

8. An underwater pool lamp as defined in claim 7 further comprising a circuit trace including a plurality of circuit trace segments each supported by one of the substrate portions, each light source connected to one of the circuit trace segments.

9. An underwater lamp comprising:

a substrate including a plurality of non-coplanar substrate portions, first selected ones of the substrate portions being parallel to one another, second selected ones of the substrate portions being nonparallel to one another;

a plurality of light sources each supported by one of the substrate portions, whereby the light sources supported by the first selected ones of the substrate portions are parallel to one another so that the light sources emit light in a parallel direction, whereby the light sources supported by the second selected ones of the substrate portions are nonparallel to one another so that the light sources emit light in nonparallel directions; and a lens assembly overlying the light sources and the substrate, the lens assembly including a plurality of lens portions each over one of the light sources.

10. An underwater lamp comprising:

a substrate including a plurality of non-coplanar substrate portions, first selected ones of the substrate portions being nonparallel to one another, second selected ones of the substrate portions being parallel to one another;

a plurality of light sources each supported by one of the substrate portions, whereby the light sources supported by the first selected ones of the substrate portions are non-coplanar to one another so that the light sources emit light in nonparallel directions, whereby the light sources supported by the second selected ones of the substrate portions are parallel to one another so that the light sources emit light in a parallel direction; and a lens assembly overlying the light sources and the substrate, the lens assembly including a plurality of lens portions each over one of the light sources.

* * * * *